US005090365A

United States Patent [19]

Hotta et al.

[11] Patent Number: 5,090,365

[45] Date of Patent: Feb. 25, 1992

[54] VARIABLE VALVE TIMING SYSTEM IN AN ENGINE HAVING A ROTATING CAM-SHAFT

[75] Inventors: Koji Hotta, Ama; Junichi Kano, Kariya; Kongoh Aoki, Toyota, all of Japan

[73] Assignee: Aisin Seiki Kabushiki Kaisha, Kariya, Japan

[21] Appl. No.: 669,938

[22] Filed: Mar. 15, 1991

[30] Foreign Application Priority Data

Mar. 29, 1990 [JP] Japan ..... 2-82457

[51] Int. Cl.[5] ..... F01L 1/34

[52] U.S. Cl. ..... 123/90.17; 123/90.31; 464/2

[58] Field of Search ..... 123/90.12, 90.15, 90.17, 123/90.31; 464/2

[56] References Cited

U.S. PATENT DOCUMENTS

| | | | |
|---|---|---|---|
| 4,787,345 | 11/1988 | Thoma | 123/90.17 |
| 4,841,924 | 6/1989 | Hampton et al. | 123/90.17 |
| 5,012,774 | 5/1991 | Strauber et al. | 123/90.17 |

FOREIGN PATENT DOCUMENTS

| | | |
|---|---|---|
| 623111 | 1/1987 | Japan . |
| 211809 | 1/1990 | Japan . |
| 2149707 | 6/1990 | Japan . |

*Primary Examiner*—E. Rollins Cross
*Assistant Examiner*—Weilun Lo
*Attorney, Agent, or Firm*—Oblon, Spivak, McClelland, Maier & Neustadt

[57] ABSTRACT

A variable valve timing system comprises a first timing member driven by the engine, a second timing member rotatably fixed to the crankshaft, a helical device engaged between the first and second timing members and including a piston movable for adjusting an angular position between the first and second timing members, a hydraulic circuit device for selectively applying a hydraulic pressure to the piston for selectively moving the piston to adjust the angular position, a damper device on the first and second timing members for hydraulically damping rotational vibrations between the first timing member and the second timing member, and a notch formed at least on one of the first timing member and the second timing member in the damper device. Torque variations applied to the second timing member relative so the first timing member do not cause a change in the angular position.

6 Claims, 3 Drawing Sheets

VARIABLE VALVE TIMING SYSTEM IN AN ENGINE HAVING A ROTATING CAM-SHAFT

BACKGROUND OF THE INVENTION

1. Field of the Invention

The present invention relates to a variable valve timing system in an engine having a rotating cam-shaft, and more particularly to a variable valve timing system in an engine having a rotating camshaft for driving intake and exhaust valves.

2. Discussion of the Background

A conventional variable valve timing system is disclosed in Japanese Patent Publication Laid-open Publication No. 62(1987)-3111 published without examination, and is shown in FIG. 4. The variable valve timing system 500 is used for an engine of a vehicle (not shown). In the variable valve timing system 500, a timing pulley 501 has an inner helical gear 501*a* and an outer gear 501*b*. The outer gear 501*b* is geared with a timing belt 502. A cam-shaft 503 is rotatably supported in a cylinder-head 506 of the engine and has an oil conduit 503*a* formed therein. A cylindrical member 504 forms an outer helical gear 504*a* and is held on the cam-shaft 503 by a hollow bolt 507.

A cylindrical piston system 505 includes a first piston 505*a*, a second piston 505*b*, a plate 505*c*, a first spring 505*d* and a second spring 505*e*. The first piston 505*a* and the second piston 505*b* have inner helical gears 505*a*-1 and 505*b*-1 and outer helical gears 505*a*-2 and 505*b*-2, respectively. The inner helical gears 505*a*-1 and 505*b*-1 are geared with the outer helical gear 504*a*. The outer helical gears 505*a*-2 and 505*b*-2 are geared with the inner helical gear 501*a*.

The first piston 505*a* is operatively connected with the plate 505*c*. The first spring 505*d* is interposed between the first piston 505*a* and the second piston 505*b*, so that the first piston 505*a*, the second piston 505*b* and the first spring 505*d* constitute a scissors gear system for decreasing backlash.

A cam-shaft cover 508 is fixed to the timing pulley 501 by bolts 509. A pressure chamber 510 is formed between the plate 505*c* and the cam-shaft cover 508. The pressure chamber 510 is in fluid communication with the oil conduit 503*a* via the hollow bolt 507.

In the above-mentioned variable valve timing system 500, the timing belt 502 is driven by a crank-shaft of the engine (not shown). Thus, the timing pulley 501 is rotated by the timing belt 502, and the cam-shaft 503 is rotated through the cylindrical piston system 505. The cam-shaft 503 drives some intake and exhaust valves of the engine (not shown) so that those intake and exhaust valves are opened or closed. A change of the revolution speed of the engine requires a change in the timing by which these valves are opened or closed.

High-pressure oil supplied from an oil tank (not shown) through a control valve (not shown) and the oil conduit 503*a* is introduced into the pressure chamber 510. This causes the cylindrical piston system 505 to move in the rightward direction. Therefore, the relative angle between the timing pulley 501 and the cam-shaft 503 is changed via the helical gears 501*a*, 505*a*-2 and 505*b*-2 located between the timing pulley 501 and the cylindrical piston system 505 and by the helical gears 505*a*-1, 505*b*-1 and 504*a* located between the cylindrical piston system 505 and the cam-shaft 503. Consequently, the timing by which the intake and exhaust valves are opened or closed is changed.

In the normal driving of the engine, the cylindrical piston system 505 receives a torque variation from the cam-shaft 503 as the cam lobes sequentially engage and disengage the cam followers, producing rotational vibrations between the timing pulley and the cam-shaft. As a result, the cylindrical piston system 505 may move in the rightward direction, even though the high pressure oil is not supplied to the pressure chamber 510. Thus, the spring 505*e* must be strong to avoid such movement of the cylindrical piston system 505.

SUMMARY OF THE INVENTION

Accordingly, it is a primary object of the present invention to absorb a rotational torque variation of a cam-shaft in a variable valve timing system.

The above and other objects are achieved according to the present invention by a variable valve timing system in an engine having a rotating cam-shaft which comprises a first timing member driven by the engine, a second timing member rotationally fixed to the crank-shaft, helical means engaged between the first and second timing members and including a piston movable for adjusting an angular position between the first and second timing members, a hydraulic circuit means for selectively applying a hydraulic pressure to the piston for selectively moving the piston to adjust the angular position, a damper means on the first and second timing members for hydraulically damping rotational vibrations between the first timing member and the second timing member, and a notch formed on at least one of the first timing member and the second timing member in the damper means, whereby the torque variations applied to the second timing member relative to the first timing member do not cause a change in the angular position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
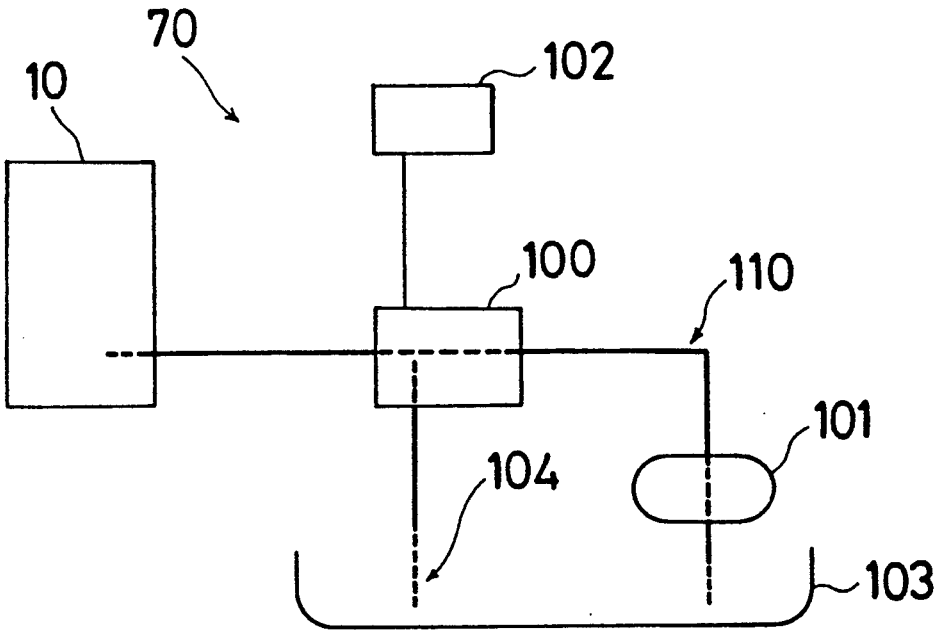
FIG. 1 is a block diagram of a variable valve timing system according to the invention.
Figure 3:
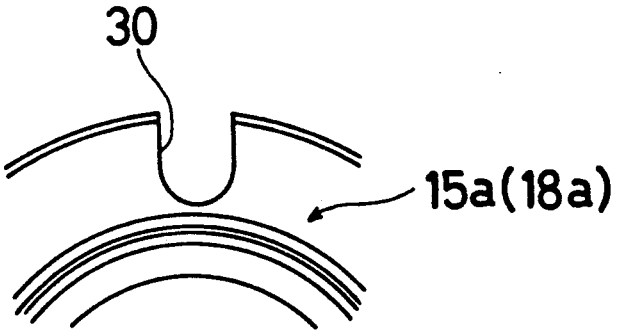
FIG. 3 is an enlarged front view of a damper case of FIG. 2.
Figure 2:
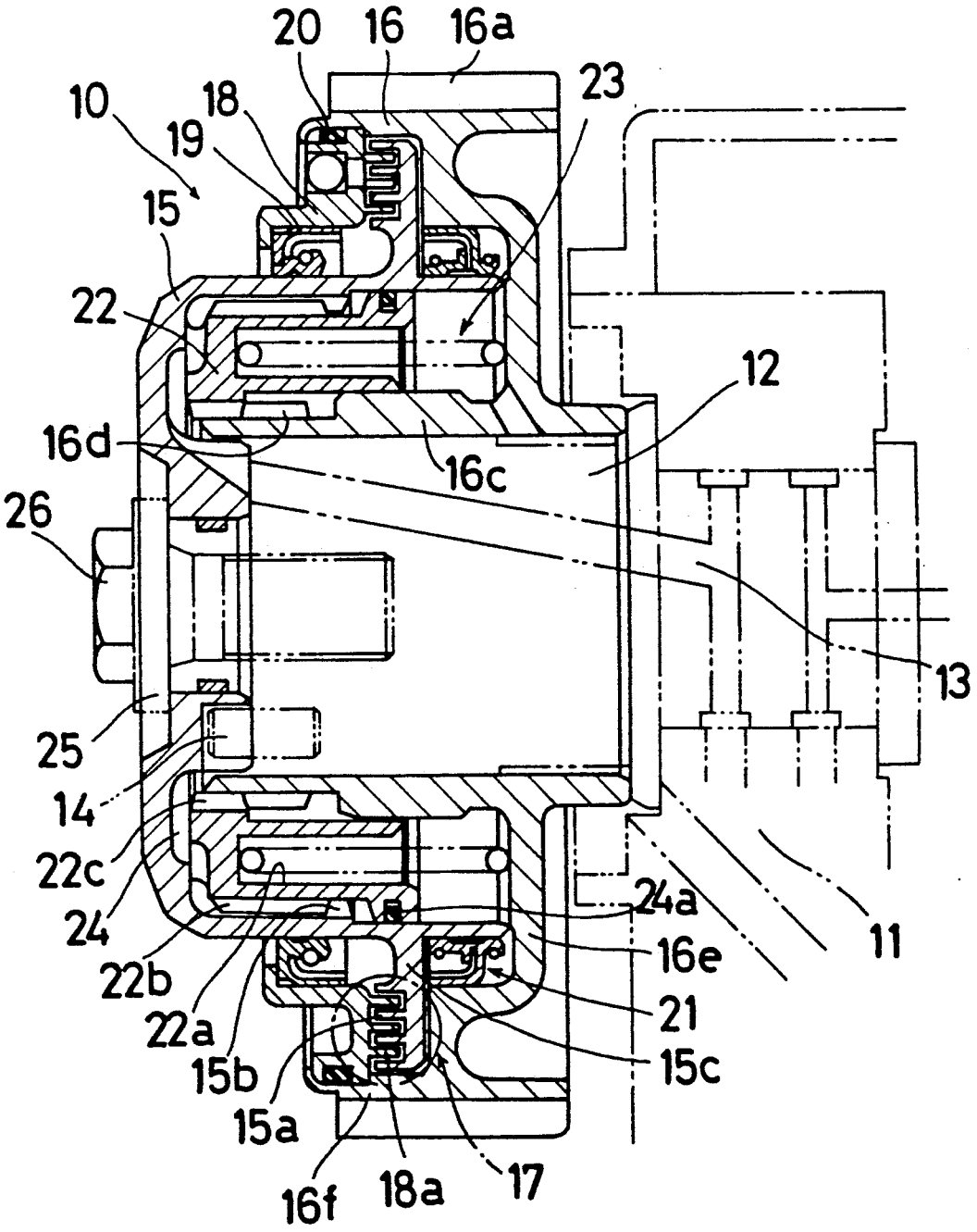
FIG. 2 is a cross-sectional view of a variable valve timing means according to the invention.
Figure 4:
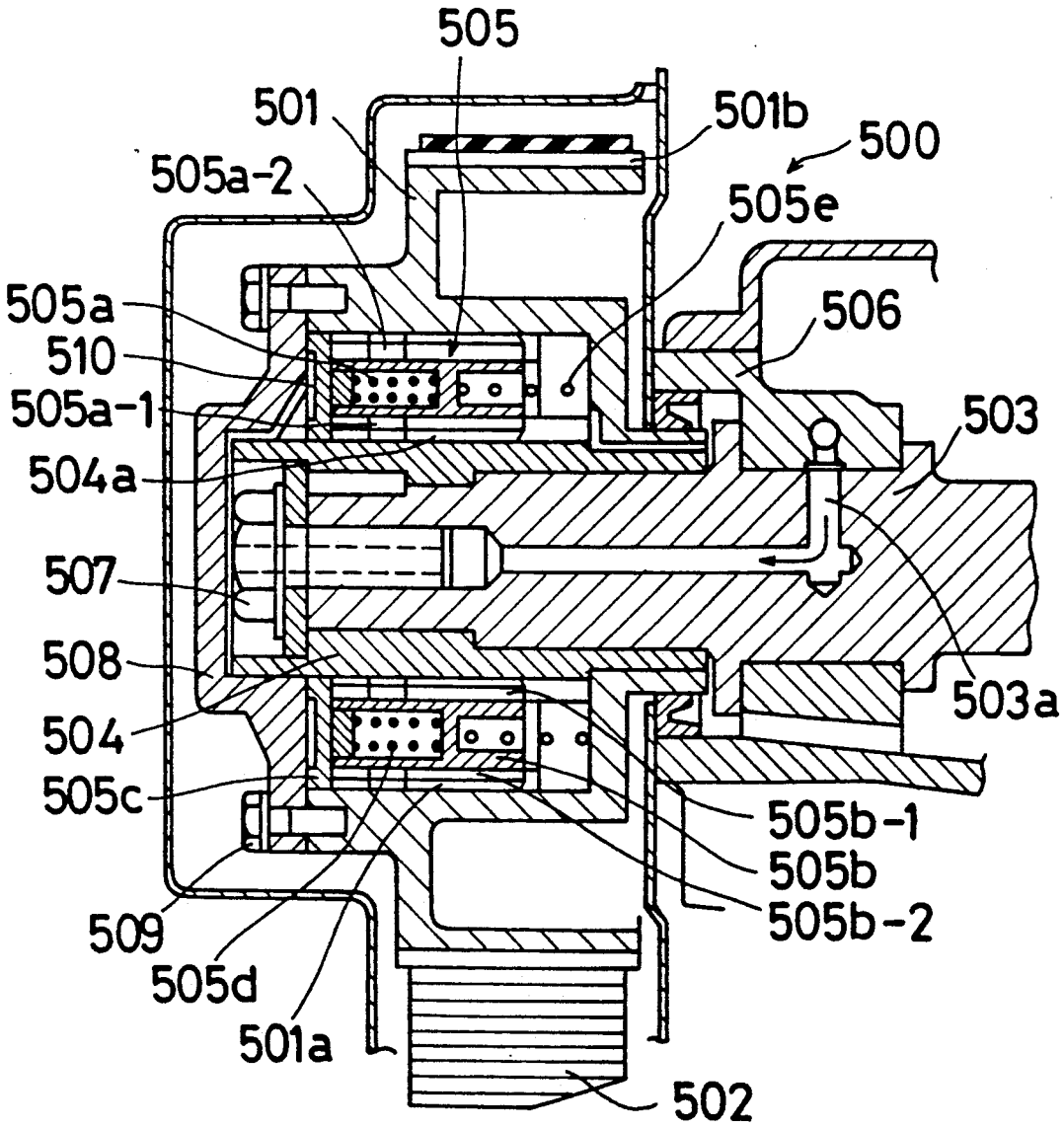
Fig. 4 PRIOR ART
FIG. 4 is a cross-sectional view of a conventional variable valve timing system.

Referring first to the embodiment of the present invention shown in FIGS. 1, 2 and 3, wherein a variable valve timing system 70 is shown. A high pressure oil source (ex. oil pump) 101 is in fluid communication with either a variable valve timing means 10 or a drain portion 104 by action of a control valve 100. The control valve 100 is controlled by the central processing unit 102. The high pressure oil source 101 and drain portion 104 are both in fluid communication with an oil-pan of an engine (not shown). Therefore, the variable valve timing system 70 is actuated by a hydraulic circuit means 110.

In the variable valve timing means 10, a cam-shaft 12 of the engine is rotatably supported by a cylinder-head 11, and has an oil conduit 13 formed therein. A timing pulley 16 (first timing member) is rotatably supported on the cam-shaft 12 and has an outer gear 16*a* which is meshed with a timing belt (not shown). An outer surface of a cylindrical portion 16*c* of the timing pulley 16 has an outer helical gear 16*d*.

A cylindrical piston (piston means) 22 has a ring-shaped groove 22*a*, an outer helical gear 22*b* and an inner helical gear 22*c*. The inner helical gear 22*c* is geared with the outer helical gear 16*d*. A spring 23 is interposed between the inside of the ring-shaped groove 22*a* and the timing pulley 16. The spring 23 urges the cylindrical piston means 22 in the leftward direction.

A damper case 15 (second timing member) has an inner helical gear 15*b* and a plurality of ring-shaped labyrinth grooves 15*a* formed in a radial flange portion 15*c* thereof. The inner helical gear 15*b* is geared with the outer helical gear 22*b*. A ring-shaped cover 18 is fixed to a flange portion 16*f* of the timing pulley 16 and sealed thereto via a sealing member 20. On the ring-shaped cover 18, a plurality ring-shaped labyrinth grooves 18*a* are oppositely meshed with the ring-shaped labyrinth grooves 15*a*. Ring-shaped labyrinth grooves 15*a* and 18*a* form a viscous damper 17. The damper case 15 is fixed to the cam-shaft 12 by knock pins 14 and a bolt 26 having a ring-shaped plate 25. Thus, the damper case 15 can not rotate relative to the cam-shaft 12. The piston 22 and the helical gears 15*b*, 16*d*, 22*b* and 22*c* together comprise helical means for adjusting an angular position between the first and second timing members.

An oil chamber 24 is located between the damper case 15 and the cylindrical piston 22. The oil chamber 24 is in fluid communication with the oil conduit 13 and is sealed by the seal ring 24*a*.

The ring-shaped cover 18 is contacted with the damper case 15 and sealed via a sealing member 19. A sealing member 21 is interposed between the damper case 15 and the arm portion 16*e*. Thus, the viscous fluid accommodated in the viscous damper 17 does not leak.

The flow of oil through conduit 13 is controlled by the control valve 100. A signal from a revolution speed sensor (not shown) of the engine, a signal from a load sensor (not shown) of the engine and a signal from a water-temperature sensor (not shown) of the engine etc. are inputted to a central processing unit 102, and the central processing unit 102 outputs the driving current to the control valve 100.

Notches 30 are formed on at least one of the ring-shaped labyrinth grooves 15*a* or the ring-shaped labyrinth grooves 18*a*. The number of notches is, for example, four. The shape of the notch 30 is, for example, U-shape. It is noted that the number of notches is not limited to four and the shape of the notches 30 is not limited to a U-shape. It is permitted that the notches 30 pass through the damper case 15 on which the ring-shaped labyrinth grooves 15*a* are formed or the ring-shaped cover 18 on which the ring-shaped labyrinth grooves 18*a* are formed (FIG. 3).

The hole 18*b* in cover 18 is used for filling the damper 17 with viscous liquid. It is closed by the seal element 18*c*.

The operation of the variable valve timing system 70 according to the embodiment is described hereinafter. The driving force of the engine is transmitted to the timing pulley 16 by the timing belt, so that the timing pulley 16 is rotated. The rotation of the timing pulley 16 is transmitted to the cam-shaft 12 through the outer helical gear 16*d*, the inner helical gear 22*c*, the cylindrical piston 22, the outer helical gear 22*b*, the inner helical gear 15*b*, the damper case 15 and the knock pins 14.

Consequently, an intake valve and/or an exhaust valve (not shown) are driven by the cam-shaft 12 via a cam (not shown). At this time, the oil pressure is not applied to the oil chamber 24, so that the cylindrical piston 22 is urged in the leftward direction (i.e., a direction to reduce the size of oil chamber 24) by the spring 23. Consequently, a certain definite valve timing condition is established.

In this definite condition of the valve timing, the timing pulley 16 is subjected to torque variations from the cam-shaft 12 via the cylindrical piston 22. There is thus a danger of rotational vibrations in the angular positions of the first and second timing members changing the relative angle between the timing pulley 16 and the cam-shaft 12, thereby producing an altered valve timing. However, the viscosity damper 17 absorbs any such vibrations due to the torque variation. Namely, the large shearing resistance of viscous fluid between the ring-shaped labyrinth grooves 15*a* and the ring-shaped labyrinth grooves 18*a* damps rotational movements of the damper case 15 which would otherwise be caused by the torque variations. Thus, the relative angle between the timing pulley 16 and the cam-shaft 12 is not changed and the valve timing is unaltered.

Now, if the running condition of the engine changes, i.e., the revolution speed of the engine, the load of the engine and/or the water-temperature of the engine, etc., it is desirable that the valve timing of the intake valves and/or the exhaust valves are changed, because the intake air quantity which the engine needs changes according to the running condition of the engine.

At this time, the central processing unit 102 outputs a driving current to the control valve 100. So, the high pressure oil flows from the high pressure oil source 101 to the oil chamber 24 through the control valve 100 and the oil conduit 13.

Because of the flowing of the high pressure oil into the oil chamber 24, the cylindrical piston 22 is moved in the rightward direction against the urging force of the spring 23. By means of the helical gears 15*b*, 22*b*, 22*c*, 16*d*, the relative angle between the timing pulley 16 and the cam-shaft 12 is changed, so that the valve timing of the intake valves and/or the exhaust valves is changed.

Next, if running conditions again change so that it is no longer desirable that the valve timing of the intake valves and the exhaust valves are changed, the central processing unit 102 stops outputting the driving current. Thus, the oil in the oil chamber 24 flows to the oil-pan 103 through the oil conduit 13 and the control valve 100, so that the cylindrical piston 22 is moved in the leftward direction by the urging force of the spring 23. Thus, the relative angle between the timing pulley 16 and the camshaft 12 is returned to its original condition, so that the valve timing of the intake and/or the exhaust valves is returned to its original condition.

In the above embodiment, there are many advantages as follows:

The torque variation from the cam-shaft 12 is absorbed by a viscous damper 17 that is compact in size, so that the variable valve timing means 10 is also compact in size. Further, the viscous damper 17 absorbs the backlash between the helical gear 15*b* and the helical gear 22*b* and between the helical gear 22*c* and the helical gear 16*d*. Thus, noise is not generated in the helical gears 15*b*, 22*b*, 22*c*, 16*d*. Further, the stiffness of the spring 23 can be small, so that the cylindrical piston means 22 can be moved by low oil pressure, i.e., when the revolution of the engine is low, the oil pressure is also low. Thus, the action of the variable valve timing system is not influenced by the revolution speed of the engine. Further, the response of the variable valve timing system becomes faster.

When the damper 17 is assembled, air mixes with the viscous fluid enclosed therein. However, when the damper 17 acts, air flows through the notches 30. Thus, the air can escape from the damper 17 and the damping action of the damper 17 is not deteriorated by air mixed therein.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A variable valve timing system in an engine having a rotating cam-shaft comprising:

a first timing member driven by the engine;

a second timing member rotationally fixed to the camshaft;

helical means engaged between the first and second timing members and including a piston movable for adjusting an angular position between the first and second timing members;

hydraulic circuit means for selectively applying a hydraulic pressure to the piston for selectively moving the piston to adjust said angular position;

damper means on the first and second timing members for hydraulically damping rotational vibrations between the first timing member and the second timing member; and a notch formed on at least one of the first timing member and the second timing member in the damper means.

2. A variable valve timing system as set forth in claim 1, wherein the damper means comprises a plurality of meshing labyrinth grooves on the first and second timing members and a viscous fluid between the labyrinth grooves.

3. A variable valve timing system as set forth in claim 2, wherein the first timing member comprises a timing pulley rotatably mounted on the cam-shaft and a ring-shaped cover fixed to the timing pulley, and the second timing member comprises a damper case cooperating with the piston to define an oil chamber.

4. A variable valve timing system as set forth in claim 3, wherein the labyrinth grooves are respectively provided on the ring-shaped cover and a radial flange portion of the second timing member.

5. A variable valve timing system as set forth in claim 3, wherein the helical means comprises inner and outer gears on the piston, a helical gear on the timing pulley and meshing with the inner gear, and a helical gear on the damper case and meshing with the outer gear.

6. A variable valve timing system as set forth in claim 3, including a spring for biasing the piston so as to reduce the size of the oil chamber.

* * * * *